US007497344B2

(12) United States Patent
Chen

(10) Patent No.: US 7,497,344 B2
(45) Date of Patent: Mar. 3, 2009

(54) SUPPORTING BRACKET FOR WALL-MOUNT RACK

(75) Inventor: Henry Chen, Taipei (TW)

(73) Assignee: Protrend Co., Ltd., Taipei (TW)

( * ) Notice: Subject to any disclaimer, the term of this patent is extended or adjusted under 35 U.S.C. 154(b) by 299 days.

(21) Appl. No.: 11/385,884

(22) Filed: Mar. 22, 2006

(65) Prior Publication Data

US 2007/0221597 A1 Sep. 27, 2007

(51) Int. Cl.

| | |
|---|---|
| ***A47B 57/00*** | (2006.01) |
| ***A47B 96/06*** | (2006.01) |
| ***A47B 9/00*** | (2006.01) |
| ***A47H 1/00*** | (2006.01) |

(52) U.S. Cl. ..... 211/187; 211/103; 211/190; 248/220.41; 248/220.42; 108/108

(58) Field of Classification Search ..... 211/90.02, 211/90.03, 103, 106, 181.1, 187, 191, 192, 211/193, 206, 207, 208; 248/218.1, 220.22, 248/220.31, 220.41, 220.42, 220.43, 222.11, 248/243, 250; 403/12, 18, 187; 402/66, 402/69; 24/90.1, 133; 29/896.8; 108/106–110, 108/147.17; 140/82; 228/136; 238/378; 267/53; D8/381; 312/408

See application file for complete search history.

(56) References Cited

U.S. PATENT DOCUMENTS

| | | | | |
|---|---|---|---|---|
| 3,097,822 | A * | 7/1963 | Attwood | 248/250 |
| 3,355,134 | A * | 11/1967 | Chesley | 248/250 |
| 3,859,693 | A * | 1/1975 | Breed | 24/600.7 |
| 3,895,774 | A * | 7/1975 | Sharp | 248/243 |
| 5,346,077 | A * | 9/1994 | Randall | 211/90.03 |
| 5,364,052 | A * | 11/1994 | De Gruttis | 248/245 |
| 5,524,772 | A * | 6/1996 | Simmons | 211/4 |
| 5,813,741 | A * | 9/1998 | Fish et al. | 312/408 |
| 6,024,333 | A * | 2/2000 | Raasch et al. | 248/247 |
| 6,402,108 | B1 * | 6/2002 | Remmers | 248/243 |
| 7,021,730 | B2 * | 4/2006 | Remmers | 312/404 |
| 7,086,544 | B1 * | 8/2006 | Doench | 211/105.1 |
| 7,240,803 | B2 * | 7/2007 | Stitchick et al. | 211/106 |
| 7,392,911 | B2 * | 7/2008 | Stitchick et al. | 211/90.02 |
| 2002/0073525 | A1 * | 6/2002 | Bruyn | 29/271 |
| 2002/0178976 | A1 * | 12/2002 | Bohnacker | 108/108 |
| 2005/0045787 | A1 * | 3/2005 | Magnusson | 248/235 |
| 2005/0150850 | A1 * | 7/2005 | Stitchick et al. | 211/90.03 |

* cited by examiner

*Primary Examiner*—Lanna Mai
*Assistant Examiner*—Joshua Rodden
(74) *Attorney, Agent, or Firm*—Troxell Law Office PLLC

(57) ABSTRACT

A supporting bracket is designed to connect to a wall-mount rack by inserting hooks provided at a rear end of the bracket into holes provided on a front side of a vertical post of the wall-mount rack. The supporting bracket includes two parallelly spaced side wall portions, on top edges of which retaining slots are formed to enable the support of two shelves at two opposite lateral sides of the bracket. Two rails may be connected to two sides of the bracket for supporting a drawer-type container. A hanger may be connected to a lower side of the bracket to support a crossbar for holding suit hangers. The supporting bracket is therefore a multipurpose and highly efficient supporting member very practical for use on the wall-mount rack for supporting different types of holding members.

4 Claims, 10 Drawing Sheets

SUPPORTING BRACKET FOR WALL-MOUNT RACK

FIELD OF THE INVENTION

The present invention relates to a supporting bracket for a wall-mount rack, and more particularly to a highly efficient multipurpose supporting bracket for supporting shelves, drawer-type containers, etc. on the wall-mount rack.

BACKGROUND OF THE INVENTION

A general wall-mount rack includes a horizontal crossbar and a plurality of vertical posts. The horizontal crossbar is horizontally fixed to a wall surface high from the ground or floor, and the vertical posts are hung on the crossbar and are spaced parallel from one another and perpendicular to the ground or floor. The vertical post is provided on a front side with a row of holes, into which a supporting bracket is inserted, so that a metal wire shelf may be supported on two horizontally corresponding supporting brackets for holding things thereon. U.S. Pat. Nos. D490,697; 3,701,325; and 5,110,080 disclose wall-mount racks having the above-described structure.

The conventional supporting brackets for wall-mount rack are designed to support only one type of member for holding things. For example, the brackets disclosed in U.S. Pat. Nos. 3,701,325 and 6,024,333 are designed to support metal wire shelves only. When it is desired to mount a slide-out basket, for example, on the wall-mount rack, another type of bracket is required. Moreover, the brackets disclosed in U.S. Pat. Nos. 3,701,325 and 6,024,333 are designed to support only one metal wire shelf each. When it is desired to mount two metal wire shelves side by side at the same height on the wall-mount rack, two brackets are required to locate between the two metal wire shelves to separately support one of them. That is, the conventional brackets for wall-mount rack have only one single function and fail to meet the general consumers' requirements.

It is therefore tried by the inventor to develop a high-efficient multipurpose supporting bracket for wall-mount rack to eliminate the drawbacks existed in the conventional brackets.

SUMMARY OF THE INVENTION

A primary object of the present invention is to provide a multi-purpose and high-efficient bracket adapted to support metal wire shelves, board-type shelves, slide-out baskets, and hanger rods on a wall-mount rack.

The supporting bracket for wall-mount rack according to the present invention includes two parallel side wall portions, so that two members for holding things may be supported at two lateral sides of the bracket to locate at the same height on the wall-mount rack with simplified mounting procedures.

The two side wall portions of the supporting bracket of the present invention are provided on top edges with retaining slots to firmly hold the supported shelves to the bracket.

The supporting bracket of the present invention may have at least one rail connected to one of the two side wall portions. The rail includes two spaced L-shaped tabs, and the side wall portions of the supporting bracket are correspondingly provided with two insertion holes each, so that the rail is connected to the side wall portion by inserting the L-shaped tabs into the insertion holes. With the rails connected to two adjacent supporting brackets, a slide-out basket or a drawer may be supported on the rails to locate between the supporting brackets.

The supporting bracket of the present invention may have a hanger connected to a lower side thereof, so that a crossbar may be supported on two such hangers connected below two adjacent supporting brackets for holding suit hangers thereon.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
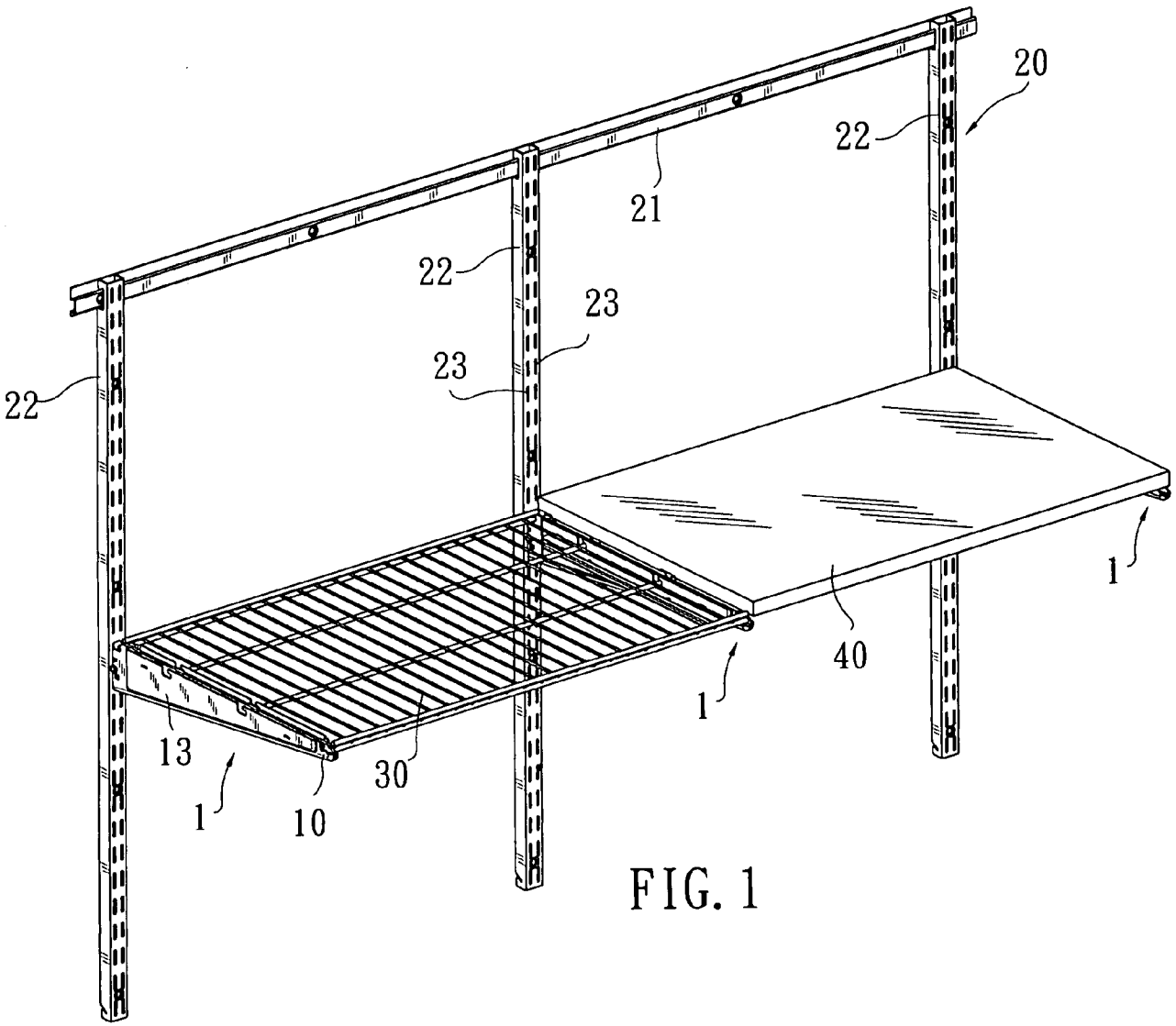
FIG. 1 is an assembled front perspective view showing the use of supporting brackets of the present invention on a wall-mount rack.

Please refer to FIG. 1 that is an assembled front perspective view of a wall-mount rack 20, on which supporting brackets 1 according to the present invention are used to support at least one shelf. The wall-mount rack 20 typically includes a horizontal bar 21; a plurality of vertical posts 22, each of which having two vertical rows of hook holes 23 provided at a front side thereof; a plurality of supporting brackets 1; and various types of things holding members, such as metal wire shelves 30, board-type shelves 40, and slide-out baskets 50 (see FIG. 7). The supporting brackets 1 are assembled to the vertical posts 22 for supporting the metal wire shelves 30, the board-type shelves 40, and/or the slide-out baskets 50 on the wall-mount rack 20.

Figure 2:
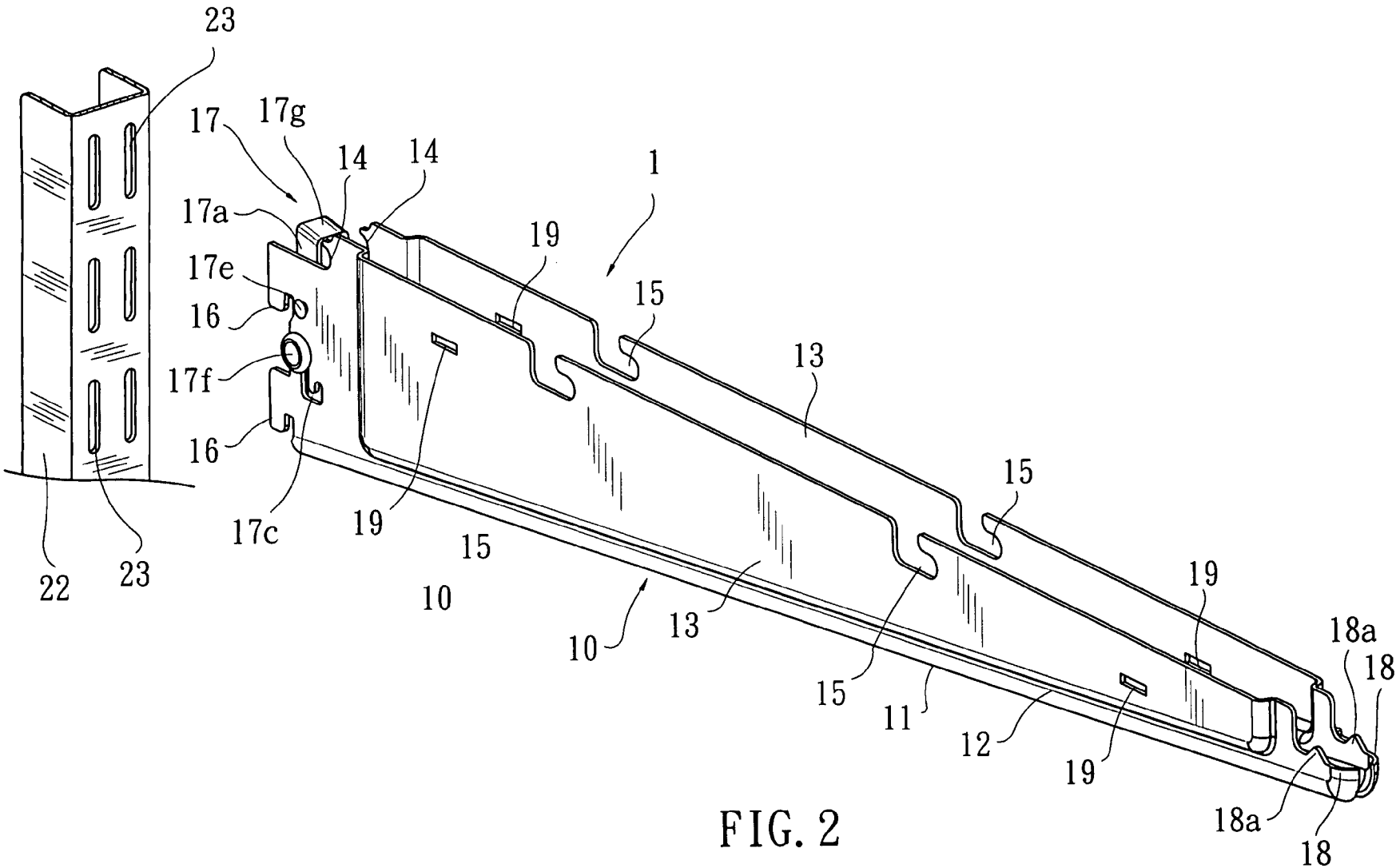
FIG. 2 is a perspective view of the supporting bracket according to a preferred embodiment of the present invention.
Figure 3:
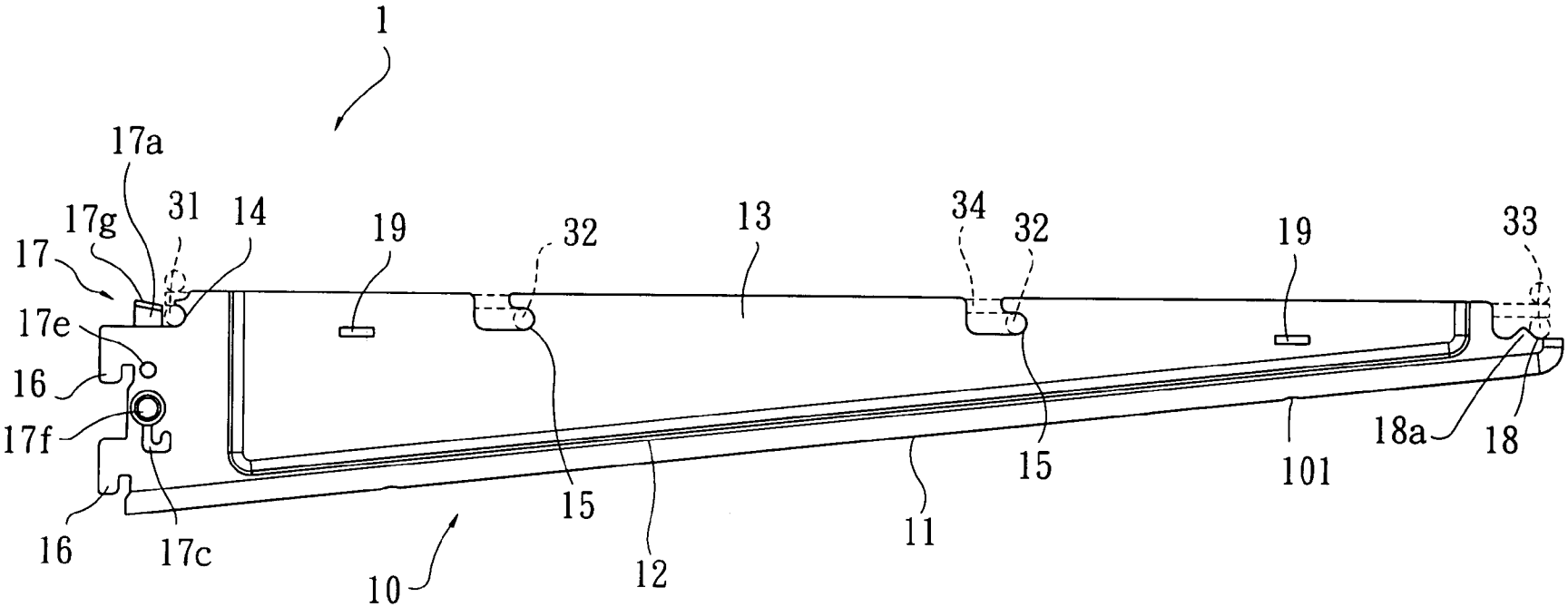
FIG. 3 is a left side view of the supporting bracket of FIG. 2.

Please refer to FIGS. 2 and 3. The supporting bracket 1 of the present invention includes a bracket body 10, and an elastic stopper 17 assembled to a rear end of the bracket body 10. The bracket body 10 includes a narrow long rib portion 11 forming a lower side of the bracket body 10, and two side wall portions 13. The narrow long rib portion 11 linearly extends by a predetermined length, and has two narrow long lateral edges 12 (only one is shown in the drawings). The two side wall portions 13 are upward extended from the two narrow long lateral edges 12 of the rib portion 11 by a predetermined height, and are parallel to each other. The two side wall portions 13 are correspondingly provided on top edges with a plurality of retaining slots 14, 15, into which an end of metal bars 31, 32 on a metal wire shelf 30 are disposed to thereby hold the metal wire shelf 30 in place on the supporting bracket 1. Since each of the two side wall portions 13 of the bracket body 10 may hold one metal wire shelf 30 thereto, two metal wire shelves 30 may be supported on the supporting bracket 1 at two opposite lateral sides thereof. The elastic stopper 17 is disposed on the bracket body 10 behind the two rearmost retaining slots 14 on the side wall portions 13, so as to normally block rearward openings of the two rearmost retaining slots 14 and prevent the metal bars 31 of the metal wire shelves 30 from moving out of the retaining slots 14.

The metal wire shelf 30 is formed by welding intersected metal wires together. The metal bar 31 forms a rear edge of the metal wire shelf 30, and the metal bars 32 are spaced intermediate transverse bars on the metal wire shelf 30 located between the metal bar 31 and a metal bar 33, which forms a front edge of the metal wire shelf. Two longitudinal side metal bars 34 are located at two lateral sides of the metal wire shelf 30. Two ends of the transverse metal bars 31, 32, 33 are perpendicularly welded to the two longitudinal side metal bars 34. When one end of the metal bars 31 and 32 of the metal wire shelf 30 are received in the retaining slots 14 and 15, respectively, on one of the two side wall portions 13 of the bracket body 10, the side metal bar 34 corresponding to that end of the metal bars 31, 32 is pressed against an inner surface of that side wall portion 13, preventing the metal wire shelf 30 from sidewardly separating from the bracket body 10.

The two side wall portions 13 are provided at a rear end with two vertically spaced hooks 16 each. The hooks 16 at the rear ends of the two side wall portions 13 may be extended into and hooked to the hook holes 23 at the front side of the vertical post 22, so as to hold the supporting bracket 1 to the wall-mount rack 20. When the supporting bracket 1 has been fully assembled to the vertical post 22 of the wall-mount rack 20, the top edges of the two side wall portions 13 are in or close to a horizontal position. The retaining slots 14, 15 on each of the two side wall portions 13 of the supporting bracket 1 are adapted to receive one end of the metal bars 31, 32, respectively, on one metal wire shelf 30 and thereby provide a support to the metal wire shelf 30. Therefore, each supporting bracket 1 is able to support two metal wire shelves 30 located at two opposite lateral sides of the bracket 1.

The rearmost retaining slots 14 on the side wall portions 13 of the bracket body 10 have a rearward opening each. The elastic stopper 17 is disposed at a position adapted to partially block the rearward openings of the retaining slots 14, so as to stop the metal bars 31 of the metal wire shelves 30 received in the retaining slots 14 from moving out of the retaining slots 14 via the rearward openings thereof.

Figure 4:
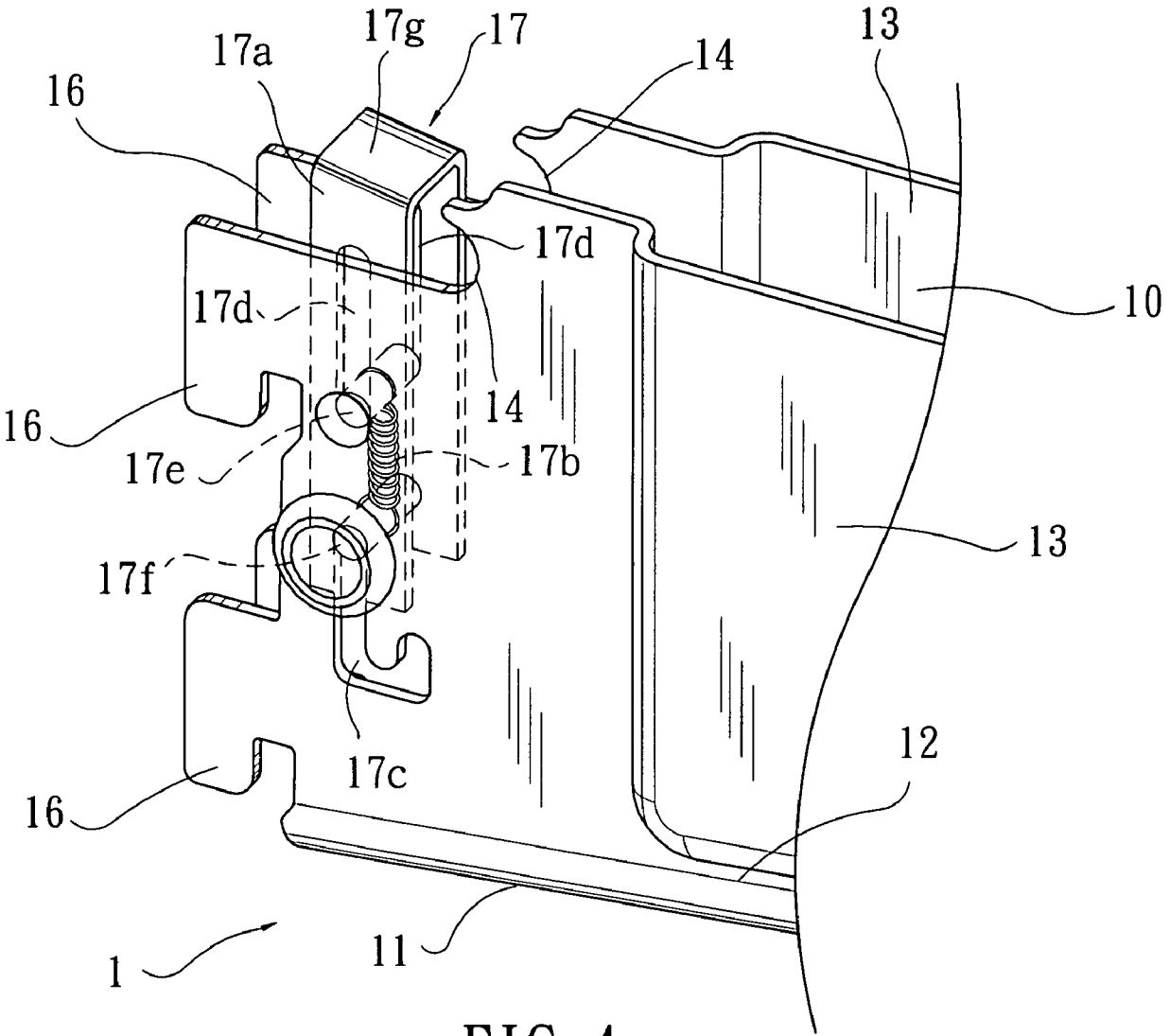
FIG. 4 is a fragmentary, enlarged view of FIG. 2.

Please refer to FIG. 4. The elastic stopper 17 includes a reversed U-shaped member 17*a*, and an elastic element 17*b*. The elastic element 17*b* normally pushes the reversed U-shaped member 17*a* upward to an elevated position just behind the retaining slots 14 to block the latter. A first rivet 17*e* immovably fixed on the bracket body 10 is extended into a long slot 17*d* formed on the reversed U-shaped member 17*a*. A second rivet 17*f* immovably fixed to the reversed U-shaped member 17*a* is extended into an L-shaped guide slot 17*c* formed on the bracket body 10, so that the reversed U-shaped member 17*a* may be moved upward and downward in the L-shaped guide slot 17*c* via the second rivet 17*f*. The elastic element 17*b* is connected at two ends to the first and the second rivet 17*e*, 17*f*, such that the reversed U-shaped member 17*a* may automatically restore to the elevated position.

A top 17*g* of the reversed U-shaped member 17*a* is a slightly forward and downward inclined surface. When an end of the metal bar 31 of the metal wire shelf 30 is pressed against the top 17*g* of the reversed U-shaped member 17*a*, the metal bar 31 is brought to move forward along the top 17*g* while presses the whole reversed U-shaped member 17*a* downward due to the weight of the metal wire shelf 30, and then automatically moves into the retaining slot 14. At this point, the reversed U-shaped member 17*a* is automatically elevated by the elastic element 17*b* to block the rearward opening of the retaining slot 14 again and locate behind the metal bar 31. Meanwhile, the ends of the metal bars 32 of the metal wire shelf 30 correspondingly sink into the retaining slots 15 on the bracket body 10, making one lateral side of the metal wire shelf 30 stably held to and supported on the bracket 1. When the two lateral sides of one metal wire shelf 30 are separately held to and supported on two adjacent supporting brackets 1, the metal wire shelf 30 is assembled to the wall-mount rack 20 for use. When it is desired to dismount the metal wire shelf 30, simply move the reversed U-shaped member 17*a* downward with the second rivet 17*f* located in a lower end of the L-shaped guide slot 17*c*. At this point, the reversed U-shaped member 17*a* is held to a lowered position, and the metal bar 31 of the metal wire shelf 30 can be removed from the retaining slot 14 to dismount the metal wire shelf 30 from the wall-mount rack 20.

In the illustrated embodiment of the present invention, there are two retaining slots 15 provided on the top edge of the side wall portions 13 of the bracket body 10. Each of the retaining slots 15 is an L-shaped slot having an open-topped vertical section and a lower horizontal section. The metal bars 32 of the metal wire shelf 30 enter the L-shaped retaining slots 15 via the open-topped vertical section. When the metal wire shelf 30 is further forward pushed, the metal bars 32 are moved into the lower horizontal section of the retaining slots 15 to restrict the metal wire shelf 30 from moving upward.

A front end 18 of each of the side wall portions 13 on the bracket body 1 is adapted to support the front transverse metal bar 33 of the metal wire shelf 30 thereon. A protrusion 18*a* is formed closely behind the front end 18 to stop the metal bar 33 from moving rearward, so that the metal wire shelf 30 assembled to the wall-mount rack 20 is stably located in place.

Figure 5:
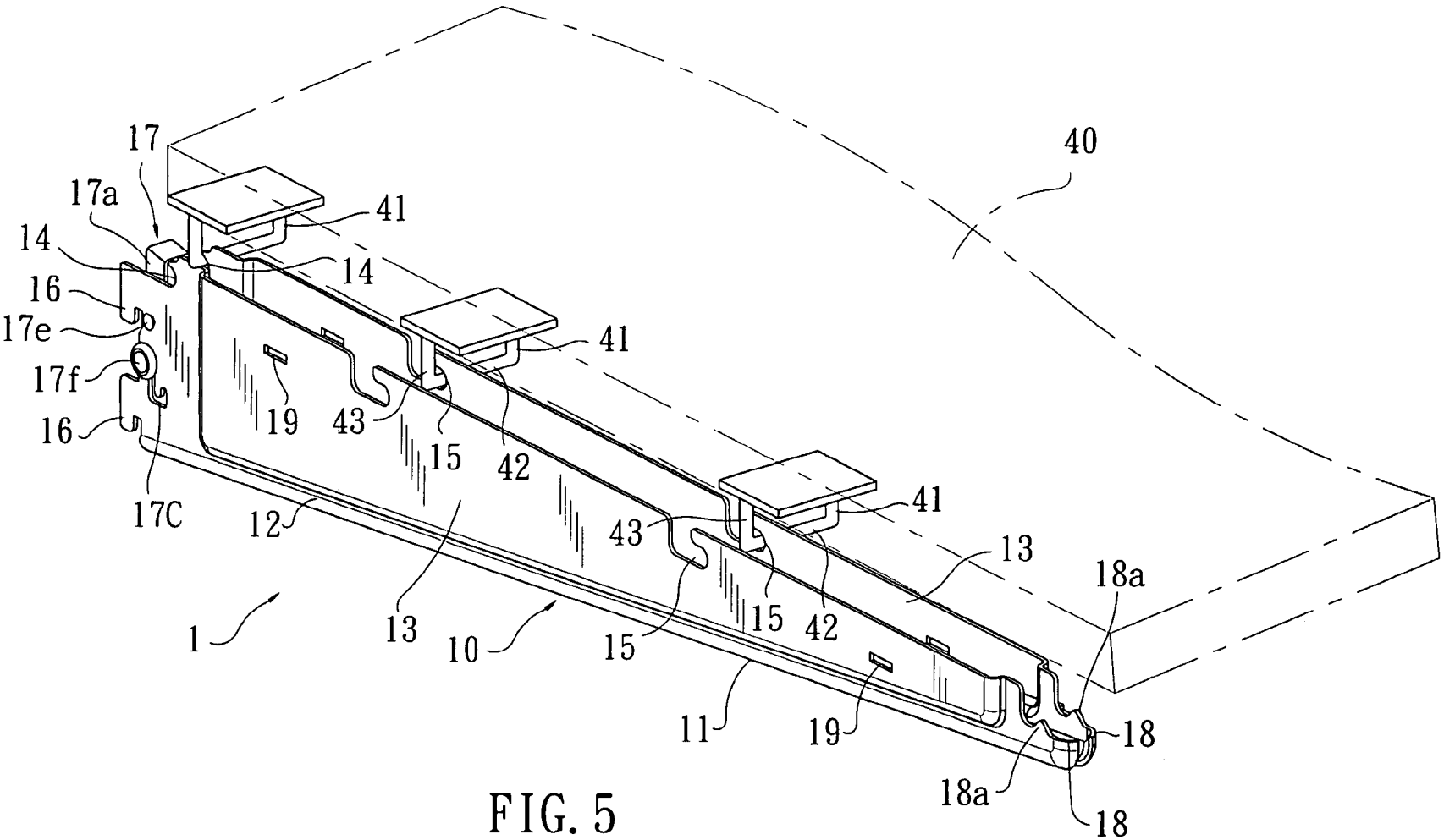
FIG. 5 shows the connection of a board-type shelf to the supporting bracket of FIG. 2

FIG. 5 shows the use of the supporting bracket 1 of the present invention to support a board-type shelf 40 thereon. The board-type shelf 40 is provided along each lateral side of a lower bottom surface with a plurality of U-shaped metal bars 41 corresponding to the retaining slots 14, 15 on the side wall portions 13 of the bracket body 10. The U-shaped metal bar 41 includes a horizontal bottom section 42 that is extended in a direction perpendicular to that of the retaining slots 14, 15, and two vertical side sections 43. When the board-type shelf 40 has been mounted to the supporting bracket 1 with the U-shaped metal bars 41 received in the retaining slots 14, 15, outer ones of the vertical side sections 43 of the U-shaped metal bars 41 are pressed against the inner surface of the side wall portion 13 to stably hold the board-type shelf 40 to the bracket body 10 for use.

Figure 6:
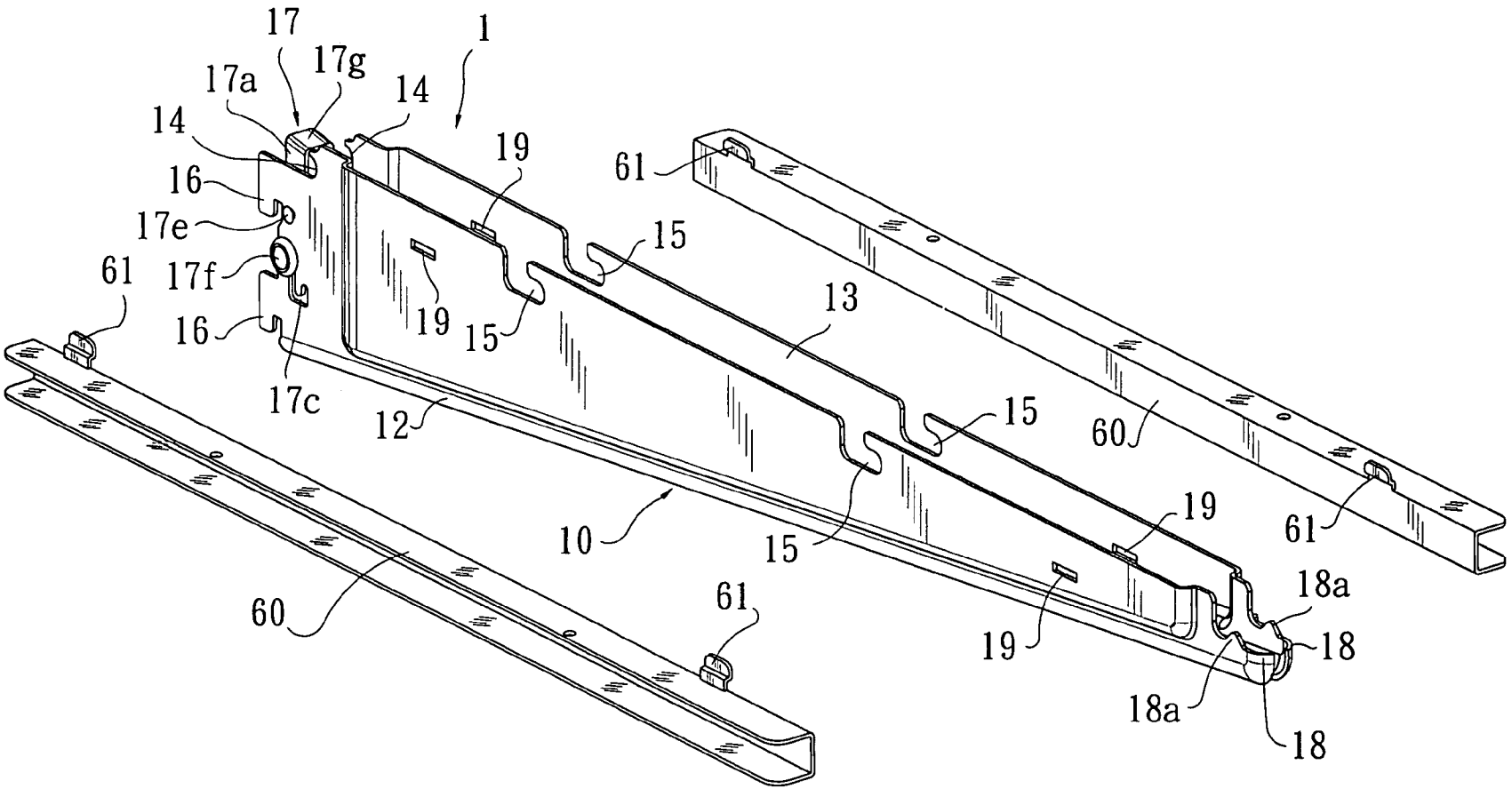
FIG. 6 is an exploded perspective view of a supporting bracket according to another embodiment of the present invention.
Figure 7:
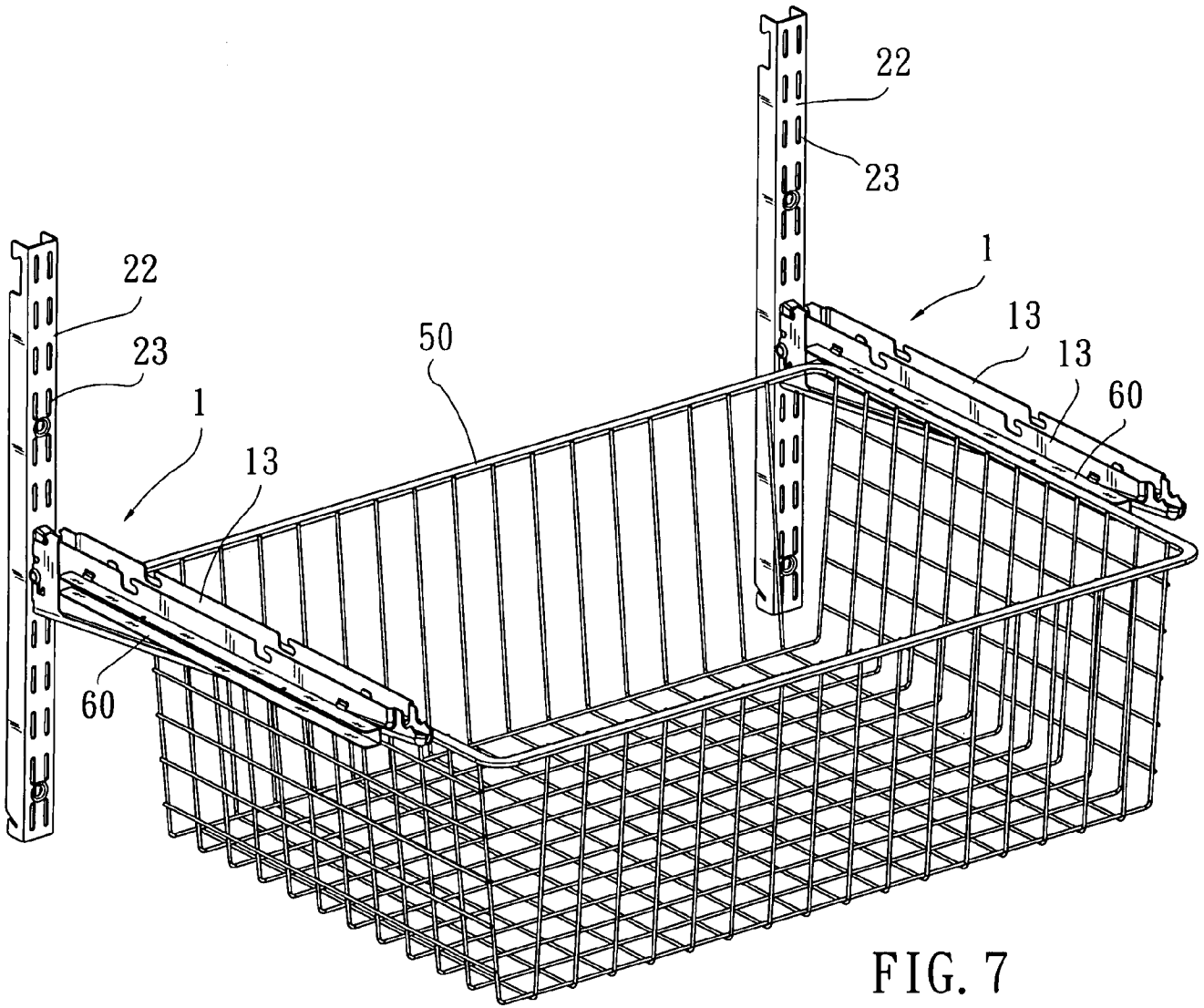
FIG. 7 shows the use of the supporting brackets of FIG. 6 to support a slide-out basket on the wall-mount rack.
Figures 8, 9:
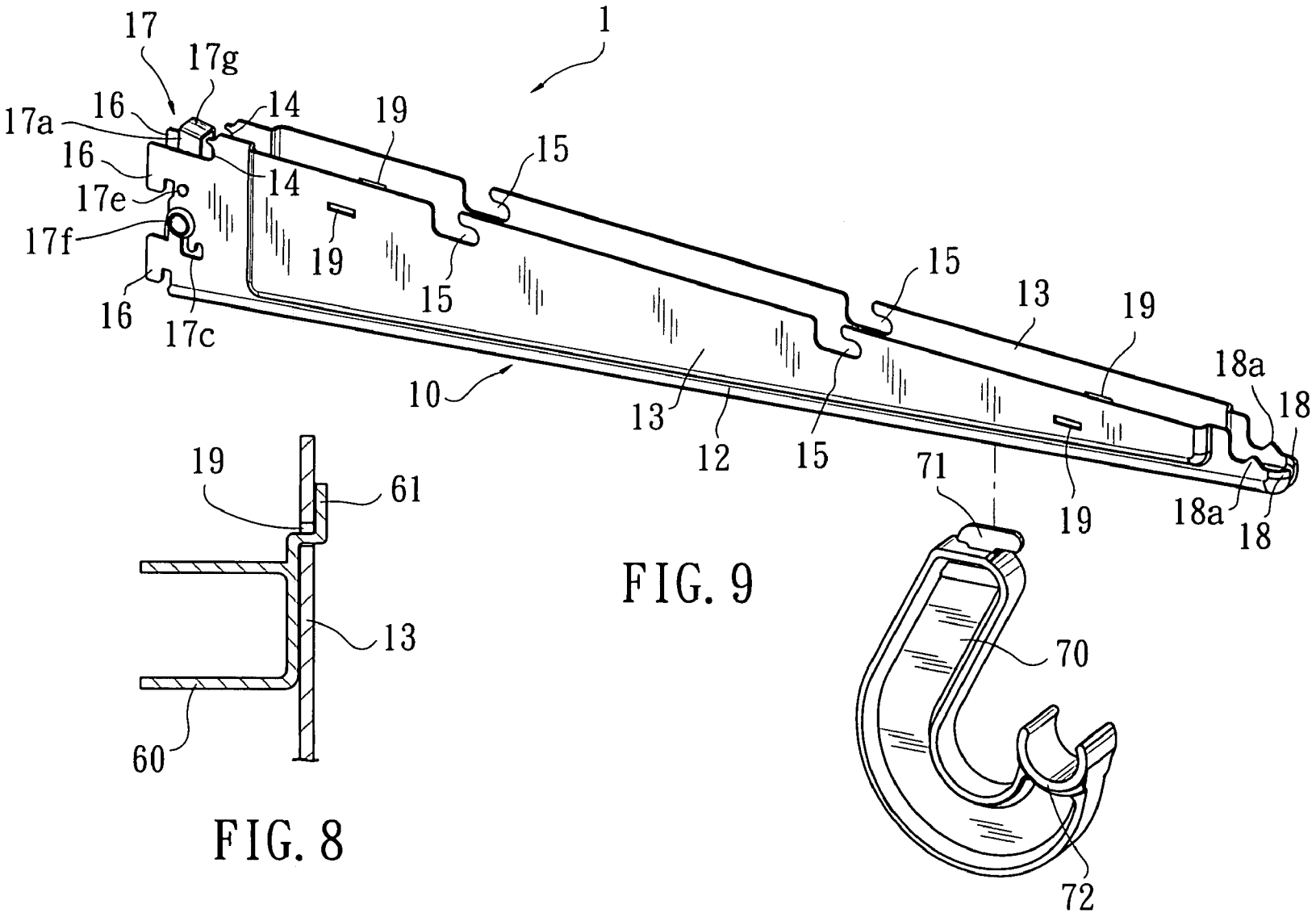
FIG. 8 is a fragmentary sectional view showing the connection of a rail to the supporting bracket of FIG. 6.
FIG. 9 is an exploded perspective view of a supporting bracket according to a further embodiment of the present invention.

Please refer to FIGS. 6, 7, and 8, in which a supporting bracket 1 according to another embodiment of the present invention is shown. The supporting bracket 1 in this another embodiment has a bracket body 10 similar to that in the preferred embodiment of FIG. 2, but further includes one or two rails 60 externally connected to a lateral side of the side wall portions 13 for supporting a slide-out basket 50 thereon. The side wall portions 13 of the bracket body 10 are correspondingly provided with a rear and a front insertion hole 19. The rail 60 is provided at predetermined positions with two L-shaped hook tabs 61 corresponding to the rear and front insertion holes 19 on the side wall portions 13. The rail 60 is connected to the bracket body 10 simply by inserting the two L-shaped tabs 61 into the two insertion holes 19. Two rails 60 may be connected to the two side wall portions 13 on each bracket body 10, so that a slide-out basket 50 or a drawer (not shown) may be supported on and between two rails 60 connected to two adjacent supporting brackets 1.

Figure 10:
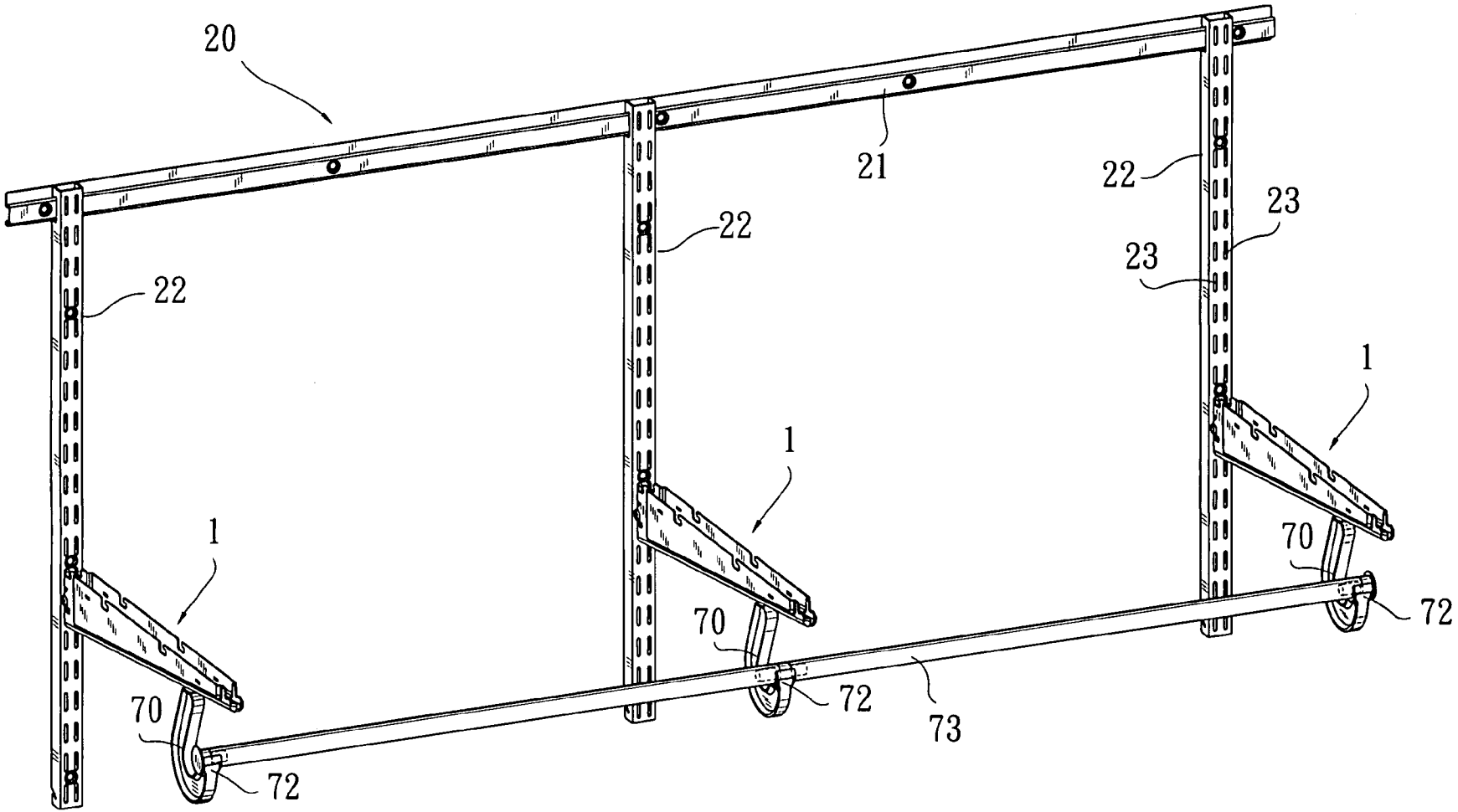
FIG. 10 shows the use of the supporting brackets of FIG. 9 to support a crossbar for holding suit hangers.
Figure 11:
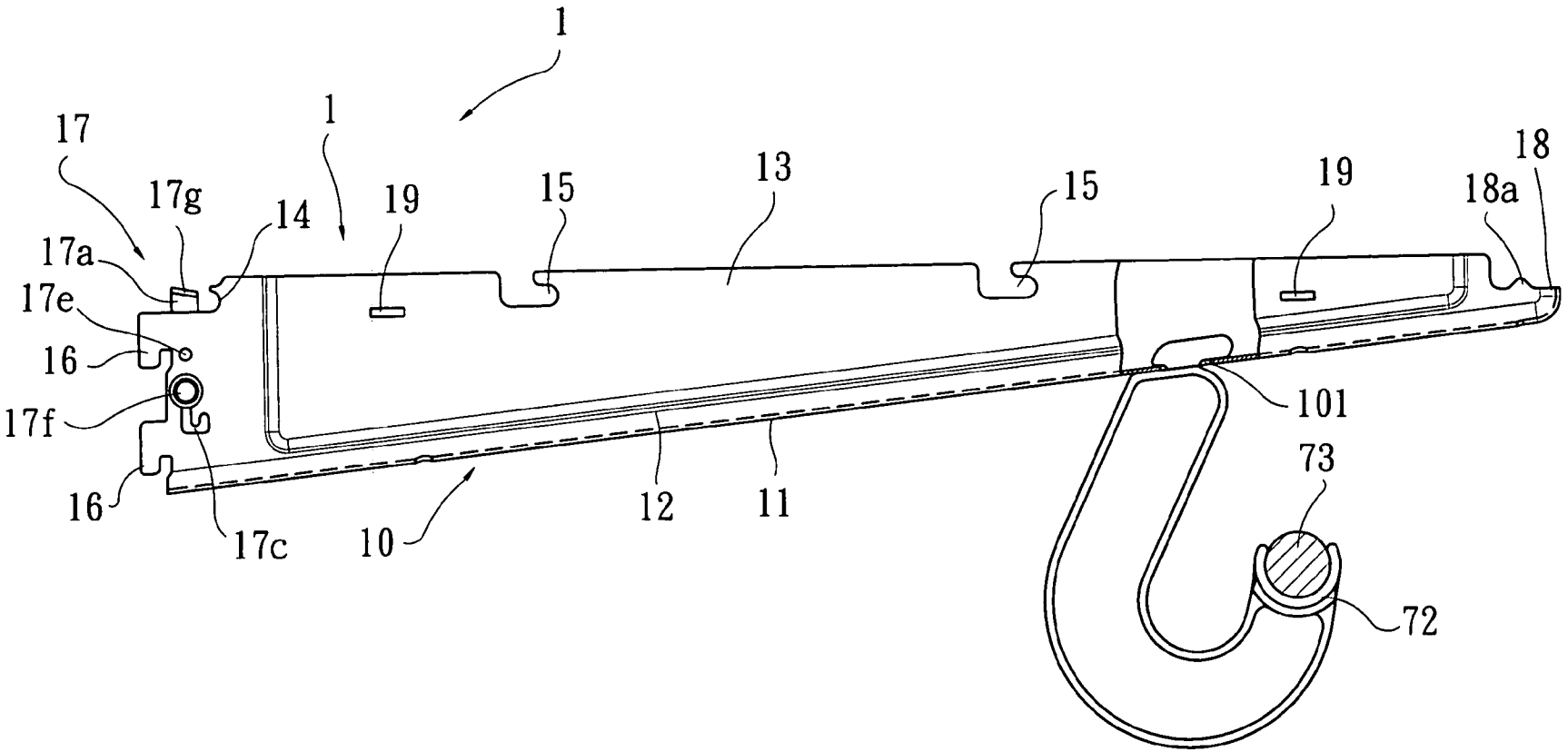
FIG. 11 is an assembled, partially sectioned side view of the supporting bracket of FIG. 9.

Please refer to FIGS. 9, 10, and 11, in which a supporting bracket 1 according to a further embodiment of the present invention is shown. The supporting bracket 1 in this further embodiment has a bracket body 10 similar to that in the preferred embodiment of FIG. 2, but further includes a hanger 70 connected to a lower side of the bracket body 10. The narrow long rib portion 11 of the bracket body 10 is provided on a bottom at a predetermined position with a longitudinally extended narrow slot 101. The hanger 70 is provided at a top with an upward projected tab 71, which is extended in the same direction as that of the narrow long rib portion 11, and is connected only at a near middle portion to the top of the hanger 70, so that a front and a rear portion of the tab 71 are longitudinally projected from the near middle portion; and at a lower free end with a supporting recess 72. The tab 71 has an overall length longer than that of the narrow slot 101. The hanger 70 is connected to the lower side of the bracket body 10 by extending the front or the rear portion of the tab 71 through the narrow slot 101 first, and then shifting the tab 71 to one end of the narrow slot 101 to allow extending of the other end portion of the tab 71 into the narrow slot 101, and then, the hanger 70 is moved for the two end portions of the tab 71 to rest on an inner side of the narrow slot 101. A crossbar 73 may be horizontally rested on the supporting recesses 72 of at least two hangers 70 for holding a plurality of suit hangers (not shown) thereon.

With the above arrangements, a user may selectively mount metal wire shelves 30, board-type shelves 40, slide-out baskets 50, or drawers on the wall-mount rack 20, and/or support a crossbar 73 below the bracket bodies 10 for holding suit hangers thereon. Therefore, the supporting components for the wall-mount rack 20 are simplified in structure and reduced in quantity, making the wall-mount rack 20 more convenient for use and more neat in appearance to increase the commercial value thereof.

What is claimed is:

1. A supporting bracket for a wall-mount rack, comprising:

a bracket body including a narrow long rib portion forming a lower side of said bracket body, and two side wall portions upward extended from two narrow long lateral edges of said rib portion by a predetermined height to be parallel to each other; said two side wall portions being correspondingly provided on their top edges with a plurality of retaining slots each; a rearmost one of said retaining slots on each of said two side wall portions having a rearward opening; and the two side wall portions being correspondingly provided with an L-shaped guide slot each; and an elastic stopper disposed on said bracket body behind the two rearmost retaining slots on said two side wall portions; said elastic stopper including a reversed U-shaped member and an elastic element, said reversed U-shaped member having a long slot formed thereon, into which a first rivet immovably fixed on the bracket body is extended; a second rivet immovably fixed to the reversed U-shaped member being extended into said L-shaped guide slots formed on said sidewall portions; and said elastic element being connected at two ends to said first and said second rivet, forcing said reversed U-shaped member to automatically elevate to a highest possible position to normally block said rearward openings of said two rearmost retaining slots on said two side wall portions of said bracket body.

2. The supporting bracket for the wall-mount rack as claimed in claim 1, wherein said reversed U-shaped member has a slightly forward and downward inclined top.

3. The supporting bracket for the wall-mount rack as claimed in claim 1, wherein at least one of said retaining slots on each of said two side wall portions is an L-shaped retaining slot.

4. The supporting bracket for the wall-mount rack as claimed in claim 1, wherein each said two side wall portions of said bracket body is provided at a rear end with at least one hook.

* * * * *